US005851134A

United States Patent [19]

Chiu

[11] Patent Number: 5,851,134

[45] Date of Patent: Dec. 22, 1998

[54] DIRECTIONAL CONTROL DEVICE FOR A MODEL VEHICLE

[75] Inventor: Shun Pui Chiu, Kowloon, Hong Kong

[73] Assignees: Ngai Keung Metal & Plastic Mfy Ltd., Hong Kong; Europlay Holding GmbH, Germany

[21] Appl. No.: 787,219

[22] Filed: Jan. 22, 1997

[51] Int. Cl.[6] ..... A63H 17/36; A63H 33/26

[52] U.S. Cl. ..... 446/468; 446/460; 446/129

[58] Field of Search ..... 446/468, 469, 446/465, 460, 456, 455, 454, 301, 129

[56] References Cited

U.S. PATENT DOCUMENTS

| | | | |
|---|---|---|---|
| 4,471,566 | 9/1984 | Ishimoto . | |
| 4,571,213 | 2/1986 | Ishimoto . | |
| 4,775,352 | 10/1988 | Curran et al. | 446/301 |
| 4,816,795 | 3/1989 | Suto . | |
| 4,881,917 | 11/1989 | Suzuki et al. | 446/468 |
| 4,964,837 | 10/1990 | Collier | 446/456 X |
| 5,281,184 | 1/1994 | Suimon . | |

FOREIGN PATENT DOCUMENTS

| | | | |
|---|---|---|---|
| 2409813 | 4/1975 | Germany | 446/468 |
| 1581242 | 12/1980 | United Kingdom | 446/456 |

*Primary Examiner*—Robert A. Hafer
*Assistant Examiner*—D. Neal Muir
*Attorney, Agent, or Firm*—Burns, Doane, Swecker & Mathis, L. L. P.

[57] ABSTRACT

A steering control mechanism for a model vehicle, e.g. a small toy vehicle, includes an electromagnetic coil wound around the wheel shaft of one of the wheels of the toy vehicle. Adjacent and facing one end of this coil are provided one or more permanent magnets on the vehicle chassis. Current is selectively applied to the coil so as to cause the wheel shaft to rotate either towards one or the other pole of the permanent magnets. The mechanism also includes position sensing means which may provide a feedback control signal to a controller to provide for progressive turning of the wheels and/or to provide automatic centering of the wheels when it is desired for the vehicle to move in a straight line.

9 Claims, 9 Drawing Sheets

DIRECTIONAL CONTROL DEVICE FOR A MODEL VEHICLE

FIELD OF THE INVENTION

This invention relates to a directional control device for a motor vehicle, and in particular to a simple small magnetically operated device that can easily be fitted in model vehicles, especially into relatively small such model vehicles.

BACKGROUND OF THE INVENTION

Radio-controlled toy vehicles are a very popular form of toy. In designing such a toy one of the challenges presented to a designer is to provide a steering mechanism by means of which not only can the radio-control cause the vehicle to stop or start, or move forwards or backwards, or to adjust its speed, but can also be used to steer the vehicle in a desired direction. Such steering mechanisms are normally linked to the front-wheels of a toy vehicle, though in principle they could equally well act on the rear wheels.

Over the years a large number of various designs have been proposed with varying degrees of success. Amongst the various features that any design should desirably have are reliability, small size and if possible the ability to control the steering progressively.

PRIOR ART

U.S. Pat. No. 5,281,184 is a fairly typical example of a traditional arrangement in which the steering is effected through an output gear of an electric motor which acts through a linkage such that the wheels are turned either to the left or to the right depending on the direction of rotation of the output gear. Although simple in principle such conventional arrangements have a number of disadvantages. For example when the wheels are turned to their maximum lock (either left or right) the motor can overheat and be damaged by the continued supply of current when the output gear is unable to rotate. To overcome this problem it has been known to include some form of disengagement mechanism, for example a church, so that the output gear can continue to rotate, but naturally this increases the complexity of the design. A further disdavantage of a design of the type shown in U.S. Pat. No. 5,281,184 is that the linkage is relatively large.

A number of proposals have been made to design a steering mechanism employing magnetic forces. Examples of these are to be found in U.S. Pat. No. 4,471,566 and U.S. Pat. No. 4,571,213 both of which are generally similar in that a steering linkage is formed with at least two permanent magnet elements of opposite polarity and the steering linkage is caused to move by energisation of an adjacent induction coil, the direction of movement of the steering linkage being dependant on the polarity of the induced magnetic field of the induction coil.

While such arrangement overcome the problem of overheating and damage of a simple electric motor driven arrangement, they do not solve the second problem and both U.S. Pat. No. 4,471,566 and U.S. Pat. No. 4,571,213 involve relatively large and cumbersome designs that limit their practical application to larger toy vehicles. In this sense U.S. Pat. No. 4,816,795 represents an improvement. In U.S. Pat. No. 4,816,795 a cylindrical magnet is provided within which is rotatably disposed a magnetic yoke about which a coil is wound and which is connected to steering linkages. Appropriate application of current to the coil wound around the yoke causes rotation of the yoke within the magnet and hence movement of the steering linkage.

Notwithstanding the above designs there remains the need for a small, simple and reliable design that can be employed in small toy vehicles, preferably with minimal re-design of the vehicle chassis.

SUMMARY OF THE INVENTION

According to the present invention therefore there is provided a steering control mechanism for a model vehicle having first and second wheels mounted on either side of a vehicle chassis, each said wheel being mounted to said chassis through a wheel shaft, and each said wheel shaft being rotatably mounted on said chassis through a shaft support whereby each said wheel shaft may rotate about an axis perpendicular to said shaft, wherein an electromagnetic coil is wound around one said wheel shaft and wherein permanent magnet means are provided on said chassis adjacent said one said wheel shaft and arranged such that opposite poles of said permanent magnet means face said electromagnetic coil and are disposed on either side of said wheel shaft when said wheel shaft is in a neutral position corresponding to straight line movement of said vehicle, and control means selectively applying current to energise said coil.

By means of such an arrangement the wheels may be turned by applying a current to the coil so as to induce a magnetic pole of a polarity such that the coil, and hence the wheel shaft, is caused to turn towards one of the poles of the permanent magnet means. Which way the wheel shaft will rotate will depend on the sense of the current applied.

Conceivably both the left and right wheels could be provided with respective coils and permanent magnet means, however this is unnecessary and not preferred. Instead preferably only one of said wheels is provided with a said coil and the first and second wheels are linked by a connecting rod so that they turn together.

Since when the wheel shaft is in a neutral straight line position it is located such that the coil is positioned between the two opposed poles of the permanent magnet means in such a position it will be in equilibrium and the two poles will tend to act so as to keep the wheel shaft in the neutral position in the absence of any current being applied to the coil. However, in some circumstances, for example when the vehicle is travelling on a rough surface, vibrations or other forces may cause the wheels to move from such a straight line position.

Preferably therefore the steering mechanism is additionally provided with automatic centering means. In one embodiment the automatic centering means may comprise position sensing means, provided for example on a connecting rod linking said first and second wheels, adapted to detect the turning position of the wheels and to output a feedback control signal to said control means.

One further advantage of the provision of such position sensing means is that if desired the output signal of the position sensing means may also be used by the control means to enable progressive steering control whereby the steering may be adjusted to a range of positions between maximum left and maximum right locks.

Another possible method of providing automatic centering is in the form of spring means adapted to bias said wheels to a straight ahead position.

Preferably the steering control mechanism is applied to the front wheels of the vehicle, though it could equally be applied to rear wheels.

It will also be understood that although the invention is described below with particular reference to toy vehicles, the invention is not so limited and could be employed in any form of vehicle, and in particular any form of remote-control vehicle, and the invention is not so limited. In addition although the invention is described below with reference to radio-control, it is equally applicable to vehicles that are controlled through a cable or wire link.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1:
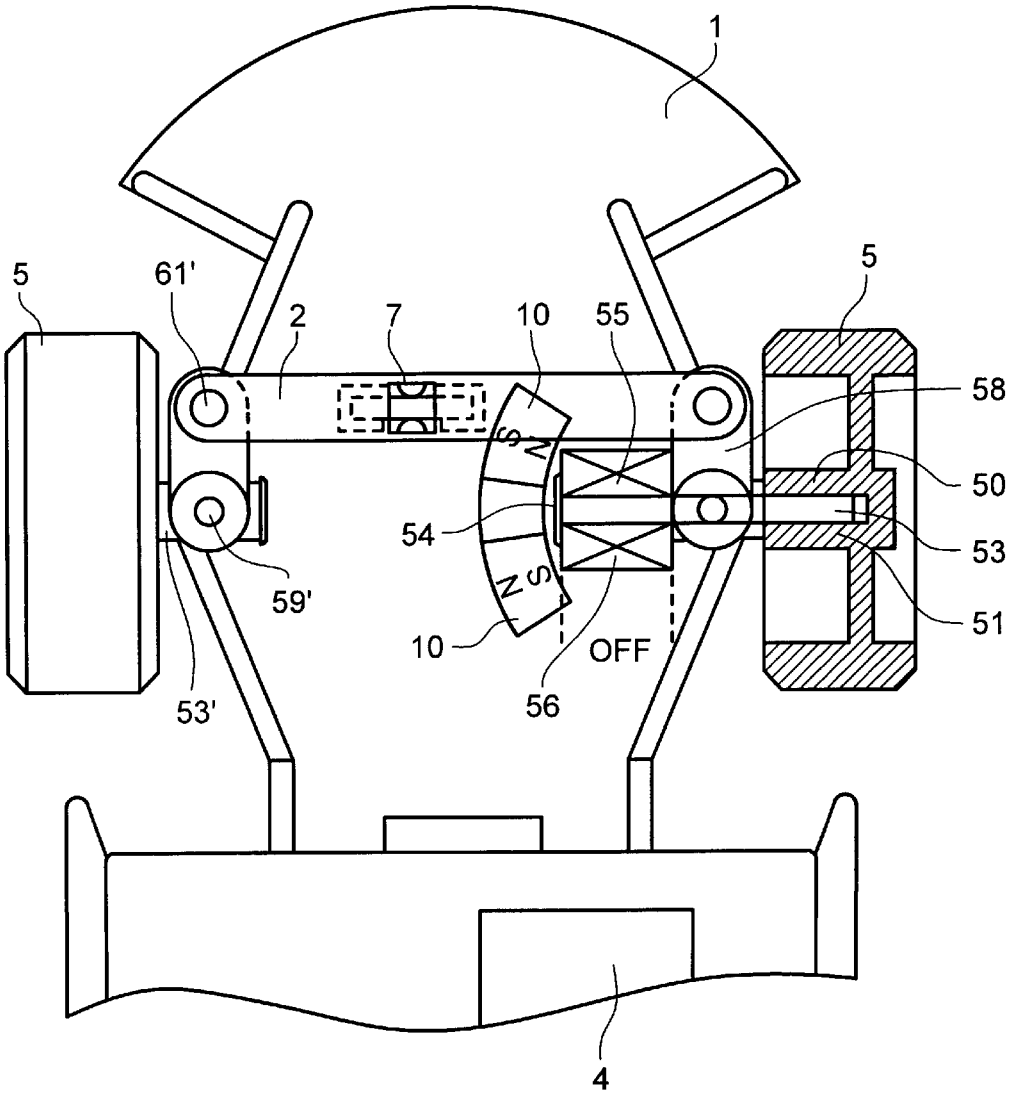
FIG. 1 is a plan view of a steering mechanism according to an embodiment of the invention with the wheels in a straight ahead position.
Figure 8:
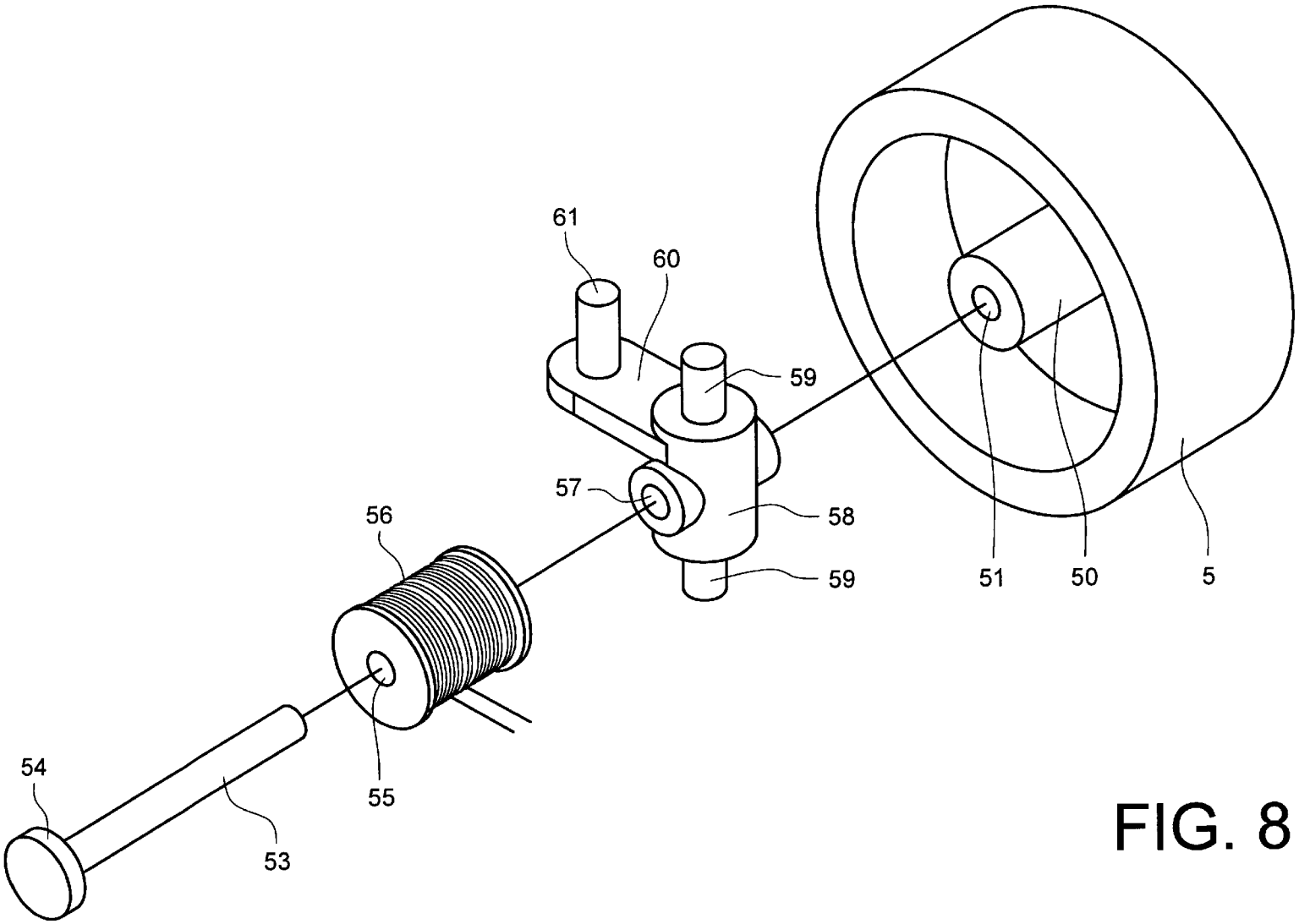
FIG. 8 is an exploded view of the structure of a wheel.

Referring firstly to FIG. 1 there is shown in plan view the front of the chassis 1 of a toy vehicle. To either side of the chassis 1 are provided left and right front wheels 5. It will be appreciated that to the rear of the chassis is provided at least one rear wheel but for clarity of the drawings that is omitted here. As is shown more clearly in FIGS. 8 & 9 each wheel 5 comprises an axle 50 formed with a cylindrical bore 51. Cylindrical bore 51 is adapted to receive a wheel shaft 53. Wheel shaft 53 is generally elongate and is formed with a nail head 54 at one end thereof. As can be seen particularly clearly in FIG. 8 wheel shaft 53 passes in turn through an axial cylindrical bore 55 formed through an electromagnetic induction coil 56, and then a cylindrical bore 57 formed in a wheel shaft support 58.

Figure 9:
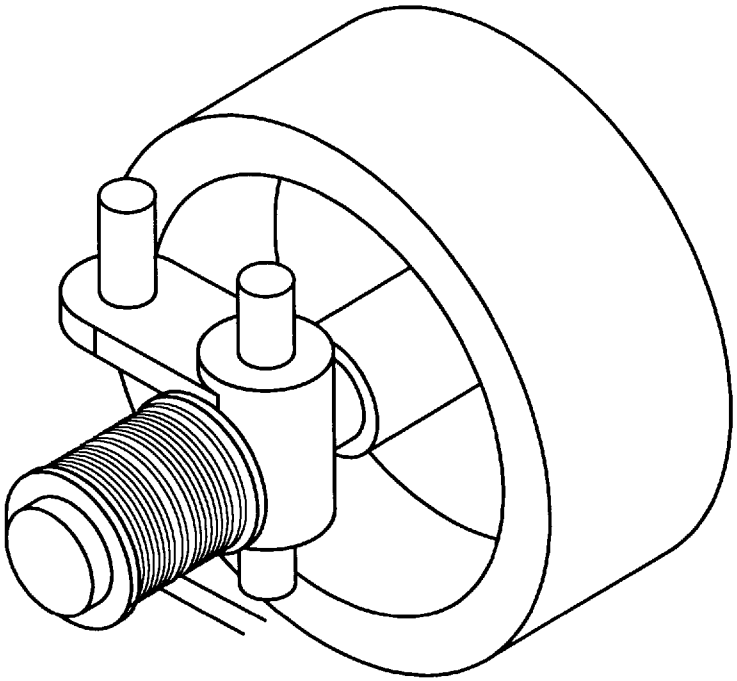
FIG. 9 is a view similar to FIG. 8 but with the wheel assembled.

As can be seen in particular in FIGS. 1 & 9 when assembled the wheel shaft support 58 is located approximately half way along the wheel shaft 53 with the wheel 5 on one side and the induction coil 56 on the other. The head 54 of the wheel shaft 53 holds the induction coil 56 in place on the wheel shaft 53.

Returning to FIG. 8 it will be seen that the wheel shaft support 58 is formed with a vertical pin 59 at right angles to the wheel shaft 53. Pin 59 is mounted on the chassis 1 in such a way that the wheel shaft support 58, and hence the wheel shaft 53 and wheel 5, can turn about the axis of pin 59. Wheel shaft support 58 also includes an arm 60 extending at right angles to both the wheel shaft 53 and the pin 59 and in turn formed with a pin 61 parallel to but laterally displaced from pin 59 and the function of which will be described more fully below.

Returning of FIG. 1 it will be seen that on the chassis 1 are formed two permanent magnets 10. Magnets 10 are formed so as to have generally curved faces and are located on a circle centered on the axis of pin 59 and with the radius of curvature of the faces of the magnets 10 conforming to the radius of the circle. Each magnet 10 has a north and south face and the two magnets are arranged so that for one magnet the north pole faces the centre of the circle, and for the other it is the south pole that faces inwardly. In addition it will be noted that the two magnets are positioned on either side of the wheel shaft 53 when it is in a neutral position corresponding to the wheels pointing straight ahead and the vehicle not turning.

It should be noted at this point that whilst in the illustrated embodiment the magnet means comprises two separate magnets 10 it would also be possible to use a single magnet, for example a horseshoe shaped magnet with the opposed north and south poles located in the positions of the two magnets 10 in the illustrated embodiment.

Figure 2:
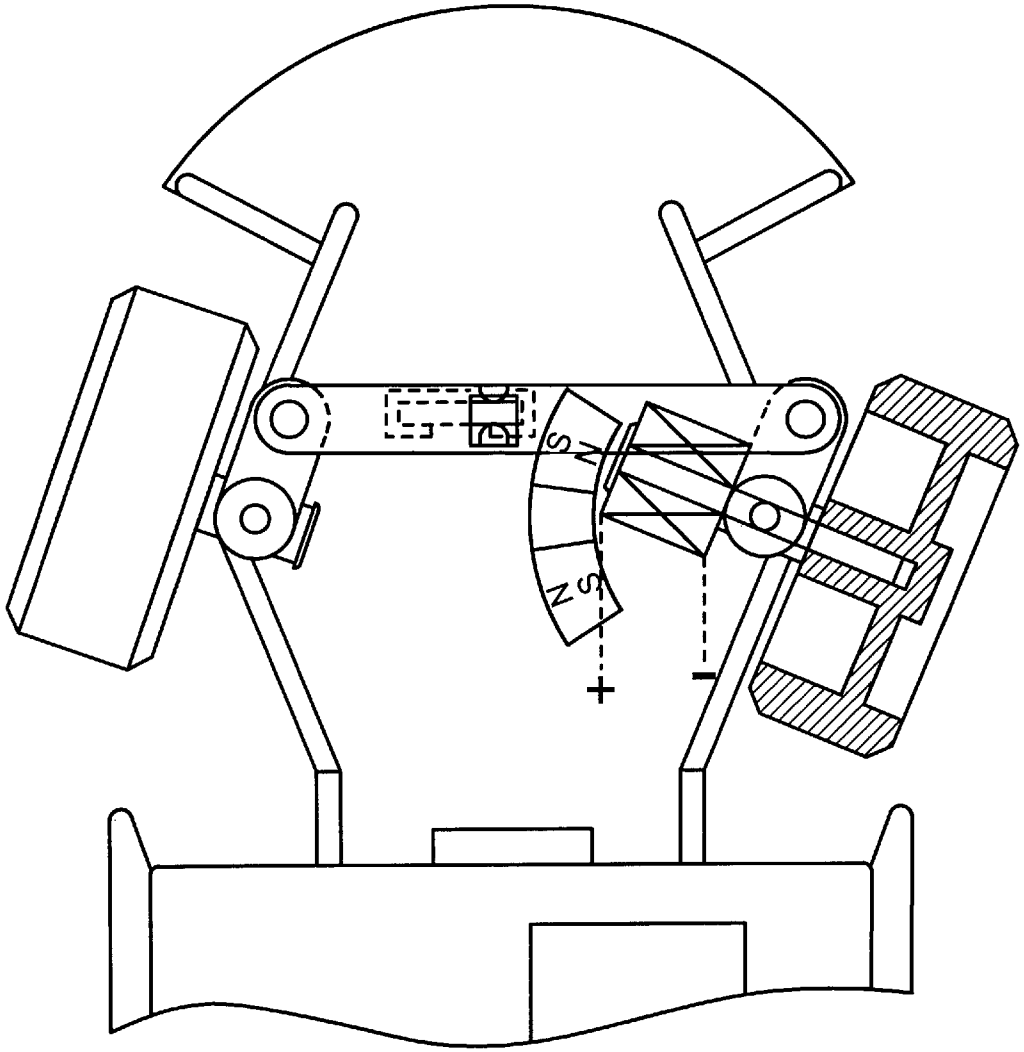
FIG. 2 is a view corresponding to FIG. 1 with the wheels turned to the right.
Figure 3:
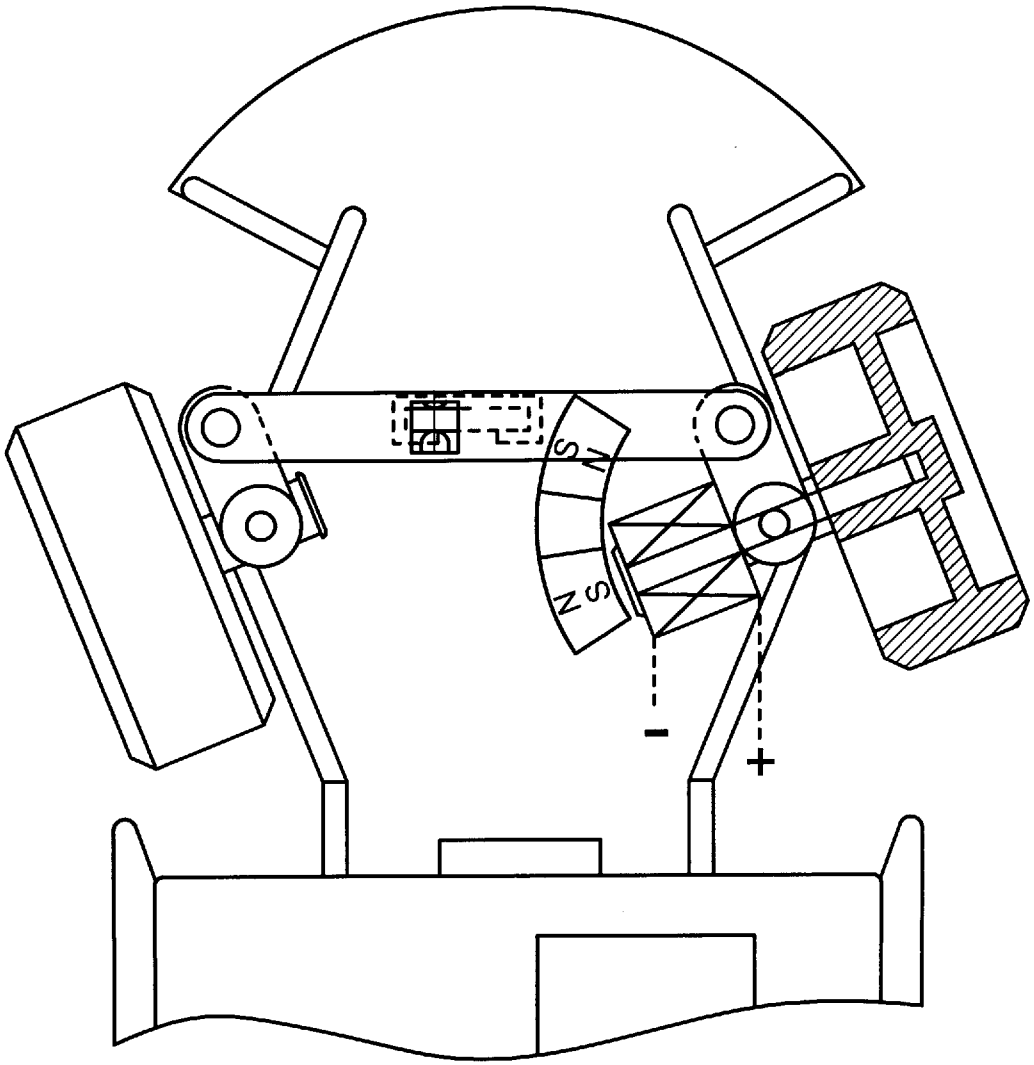
FIG. 3 is a view corresponding to FIG. 1 with the wheels turned to the left.

In the embodiment of FIGS. 1 to 3 an induction coil is formed only on the wheel shaft of the right side wheel, and the permanent magnets are located adjacent this wheel. The left side wheel is formed with a shorter wheel shaft 53' and no induction coil, but as with the right side wheel the left wheel is mounted for rotation about the axis of a pin 59' formed on a wheel shaft support 53' identical to the wheel shaft support 53 described above. The left-side wheel shaft support 53' is identical to the right-side wheel shaft support, including the provision of the extending arm 60' and the parallel but displaced pin 61'. Pin 61 and pin 61' are interconnected by a rigid connecting rod 2, as can best be seen in FIGS. 1 to 3.

Figure 6:
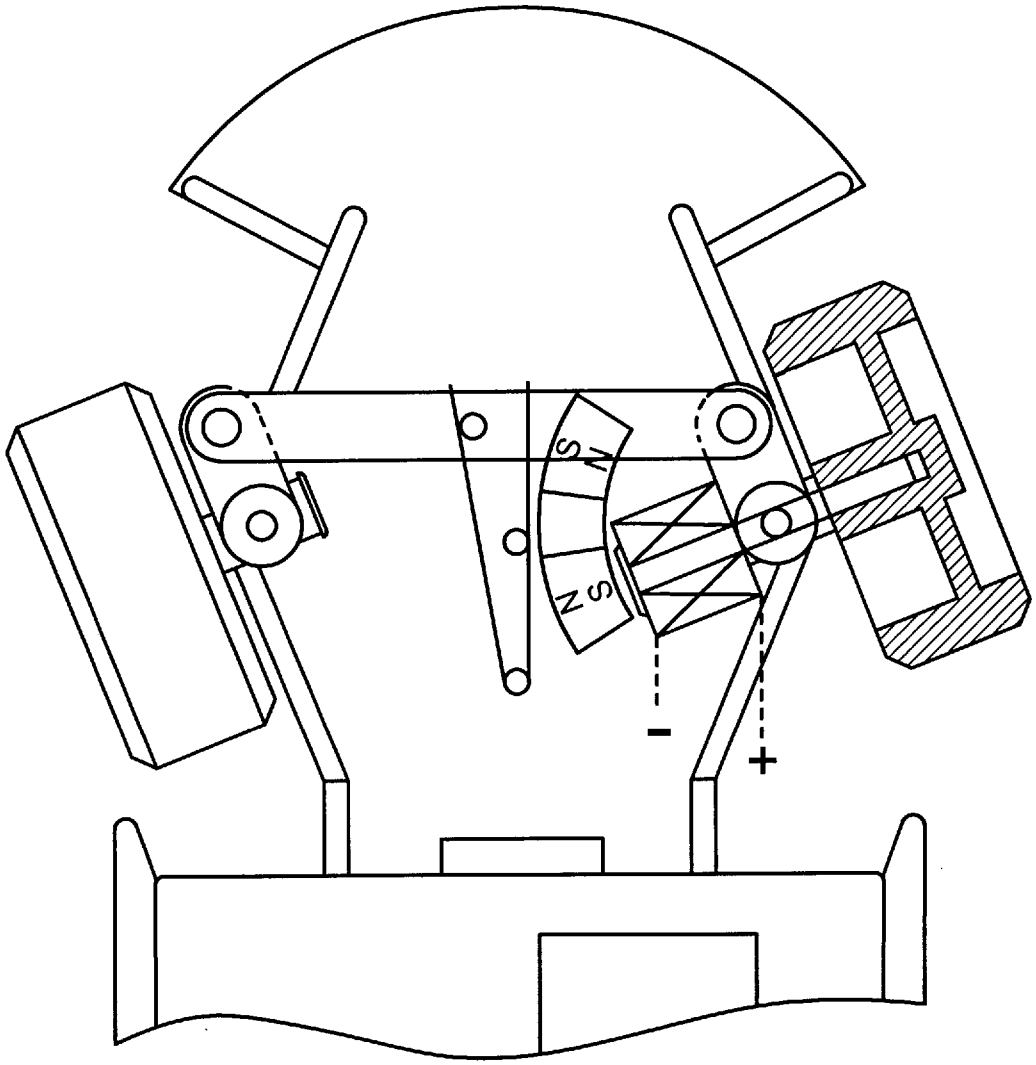
FIG. 6 is a view similar to FIG. 5 but with the wheels turned to the left.
Figure 7:
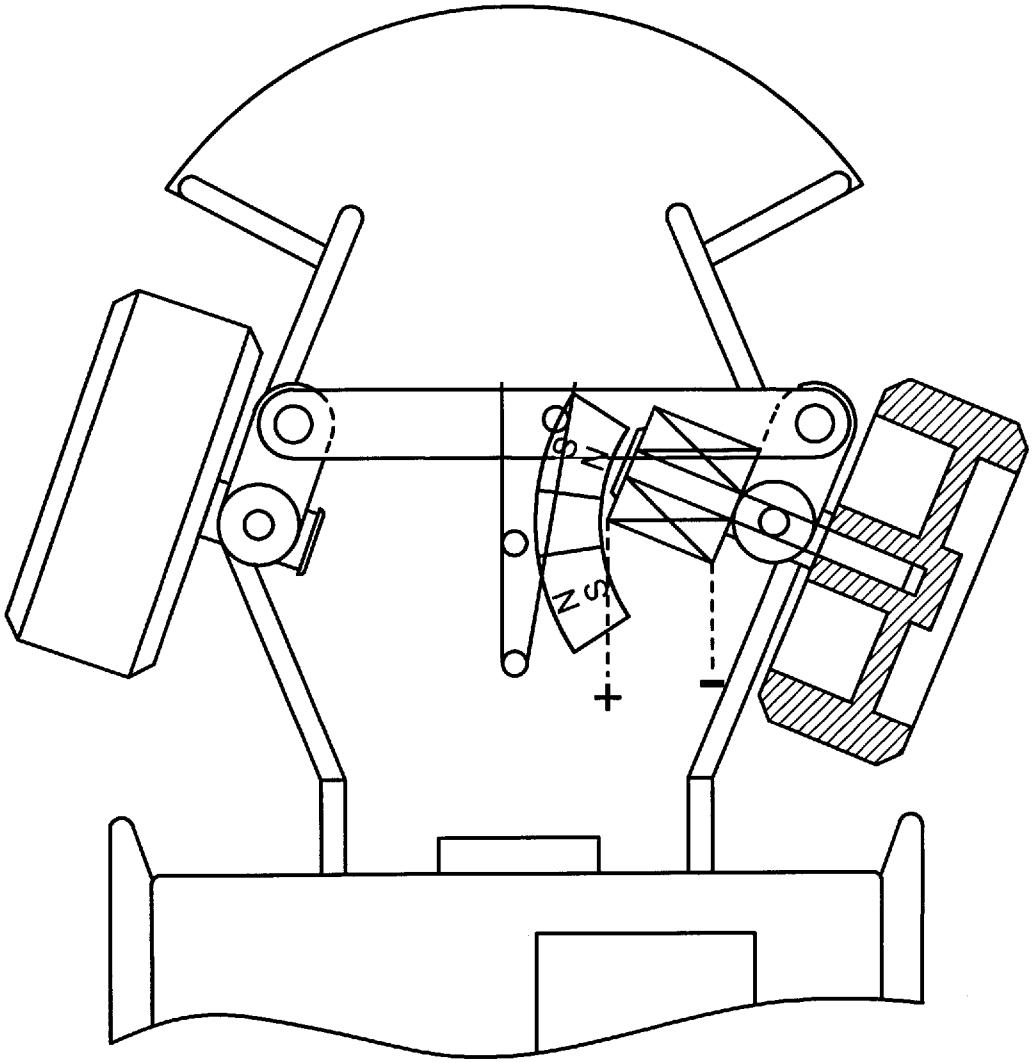
FIG. 7 is a view similar to FIG. 5 but with the wheels turned to the right.

Operation of this steering mechanism will now be described. When a user wishes the vehicle to steer to the left or to the right the radio-control bandset is operated to generate an appropriate signal to instruct the vehicle to turn. This signal is received by control means 4 located on the vehicle chassis and in turn the control means generates a signal to cause current to flow in the induction coil 56. This current in the induction coil will generate an induced magnetic field the polarity of which will be dependent on the direction of current flow in the coil 56. If the current flows in a first direction the induced magnetic field may have a south pole at the end of the coil facing the magnets 10 in which case this induced pole will be drawn towards the north pole of the permanent magnets and the wheels will turn to the right as in FIG. 2. On the other hand if the current flows in the opposite direction a north pole will be induced facing the permanent magnets 10 and the wheels will be turned to the left as shown in FIG. 3. In FIGS. 1 to 3 (and also in FIGS. 5 to 7) the relative polarity of the current in the coil is shown by the + and − signs.

As will readily be understood whichever way the right wheel turns, i.e. either to the right as in FIG. 2 or to the left as in FIG. 3, the left wheel will be caused to turn an identical amount in the same direction by means of the linkage through connecting rod 2.

When no steering of the vehicle is required and the wheels are to point straight ahead no current flows through the induction coil and the wheel shaft will be balanced in an equilibrium position between the two magnets. Notwithstanding this, however, if the surface on which the vehicle travels is rough vibrations may be passed through the wheels which may affect the straight line steering of a vehicle. Accordingly therefore a position sensor 7 may be provided to detect the position of the wheels and to provide a form of feedback signal. As can be seen in FIG. 1 the position sensor 7 is preferably located on the connecting rod 2 and detects the position of that rod relative to the chassis which in turn can be related to the position of the wheels. Any conventional form of sensor may be used.

Figure 4:
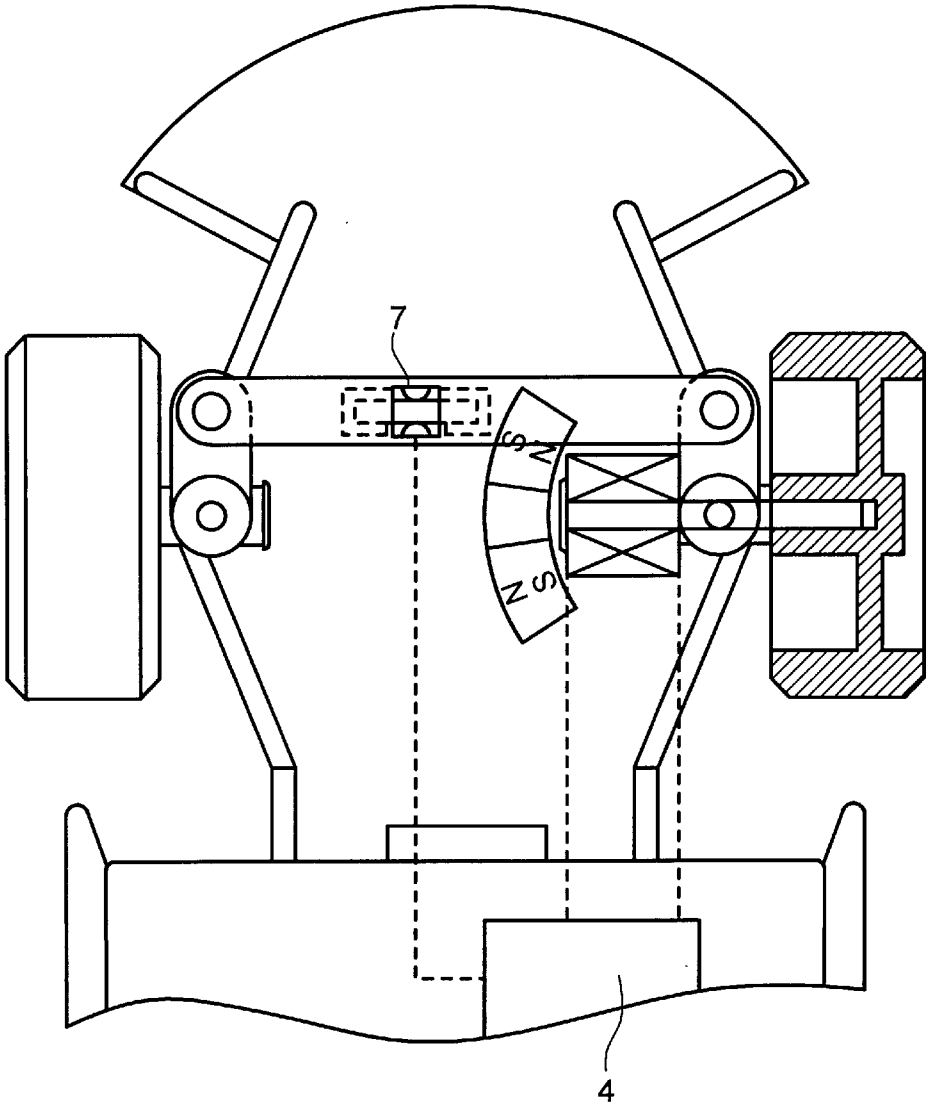
FIG. 4 illustrates schematically a control mechanism.

As is shown in FIG. 4 an output from the position sensor may be input to the control means such that if the wheels stray from a desired position for any reason a correction signal may be generated that will cause current to flow in the induction coil so as to cause a correction movement of the wheels. An additional advantage of the use of the position sensor is that it may also be employed to adapt the steering control mechanism so that it can progressively control the steering, i.e. so that the wheels may be located in a range of positions relative to the neutral position, and not just the two extreme positions shown in FIGS. 2 & 3. This may be achieved by arranging for the position sensor to provide an appropriate feedback control signal.

Figure 5:
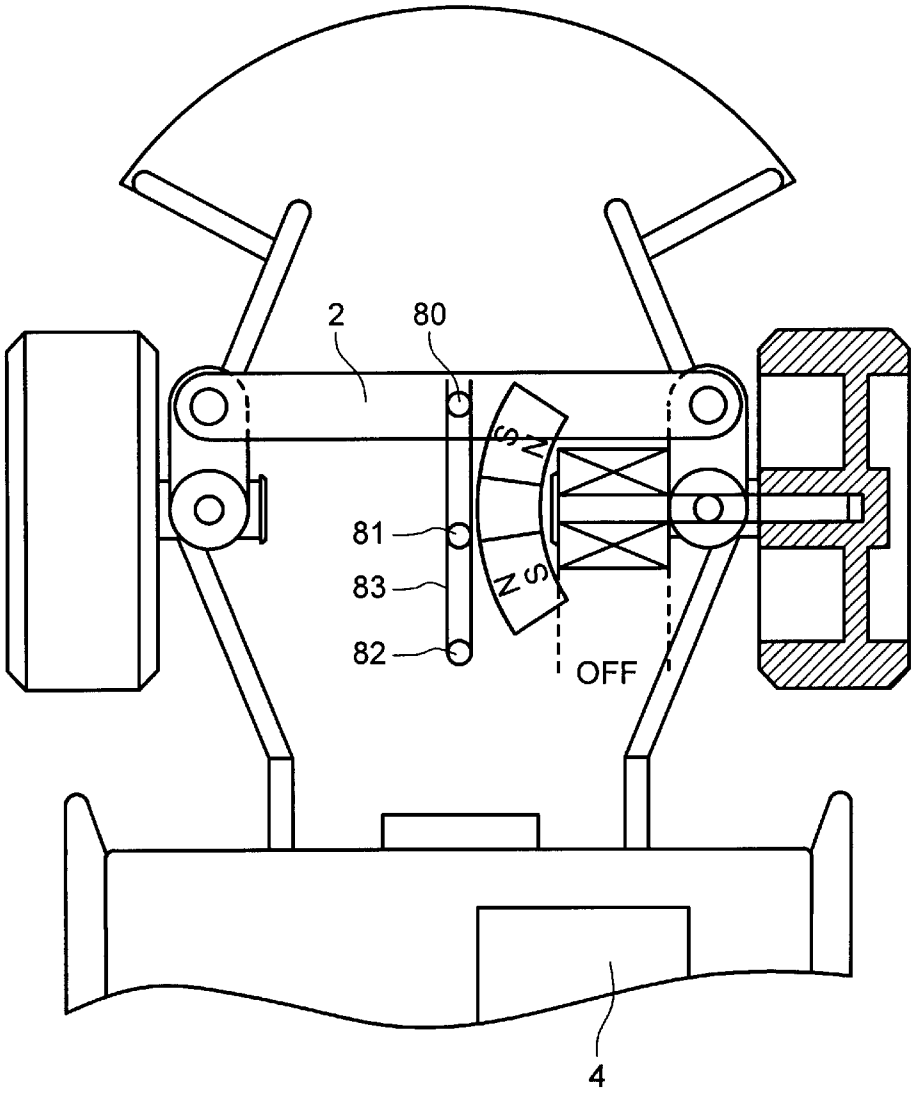
FIG. 5 is a view similar to FIG. 1 but of an alternate embodiment.

FIG. 5 shows an alternative and simpler form of automatic centering mechanism. In this embodiment a pin 80 is formed on the connecting rod 2 at a central point there along, and two corresponding pins 81 and 82 are formed on the chassis along a centre line of the chassis—the three pins all being in line. Around these pins is provided a spring 83. With this arrangement whenever the wheels are turned from their neutral straight ahead position, e.g. to the left as in FIG. 6 or to the right as in FIG. 7, a restoring spring force is generated to urge the wheels back to the neutral position.

I claim:

1. A steering control mechanism for a model vehicle having first and second wheels mounted on either side of a vehicle chassis, each said wheel being mounted to said chassis through a wheel shaft, and each said wheel shaft being rotatably mounted on said chassis through a shaft support whereby each said wheel shaft may rotate about an axis perpendicular to said shaft, wherein an electromagnetic coil is wound around at least one said wheel shaft on the side of said shaft support that is opposite said wheel, and wherein permanent magnet means are provided on said chassis adjacent said one wheel shaft and arranged such that opposite poles of said permanent magnet means face said electromagnetic coil and are disposed on either side of said wheel shaft when said wheel shaft is in a neutral position corresponding to straight line movement of said vehicle, and control means for selectively applying current to energise said coil.

2. A steering control mechanism as claimed in claim 1 wherein said first and second wheels are linked by a connecting rod and only one of said wheels is provided with a said electromagnetic coil.

3. A steering control mechanism as claimed in claim 1 wherein position sensing means are provided for detecting the turning position of said wheels.

4. A steering control mechanism as claimed in claim 3 wherein said first and second wheels are linked by a connecting rod and said position sensing means is mounted on said connecting rod.

5. A steering control mechanism as claimed in claim 3 wherein said position sensing means outputs a feedback control signal to said control means.

6. A steering control mechanism as claimed in claim 1 wherein said mechanism includes automatic centering means.

7. A steering control mechanism as claimed in claim 6 wherein said automatic centering means comprises position sensing means for detecting the turning position of said wheels and said position sensing means outputs a feedback control signal to said control means.

8. A steering control mechanism as claimed in claim 6 wherein said automatic centering means comprises spring means that biases said wheels to a straight ahead position.

9. A model vehicle having first and second wheels mounted on either side of a vehicle chassis, each said wheel being mounted to said chassis through a wheel shaft, and each said wheel shaft being rotatably mounted on said chassis through a shaft support whereby each said wheel may rotate about an axis perpendicular to said shaft, wherein an electromagnetic coil is wound around at least one said wheel shaft on the side of said shaft support that is opposite said wheel and wherein permanent magnet means are provided on said chassis adjacent said one wheel shaft and arranged such that opposite poles of said permanent magnet means face said electromagnetic coil and are disposed on either side of said wheel shaft when said wheel shaft is in a neutral position corresponding to straight line movement of said vehicle, and control means for selectively applying current to energise said coil.

* * * * *